US012053813B2

(12) United States Patent
Knoche et al.

(10) Patent No.: US 12,053,813 B2
(45) Date of Patent: Aug. 6, 2024

(54) SHAPING TOOL, METHOD FOR PRODUCING AN EDGE ON A COMPONENT, AND METHOD FOR PRODUCING A SHAPING TOOL OF THIS KIND

(71) Applicant: Bayerische Motoren Werke Aktiengesellschaft, Munich (DE)

(72) Inventors: Stephan Knoche, Seligenstadt (DE); Christian Meier, Landshut (DE); Gerhard Wallner, Landau an der Isar (DE); Christian Zausinger, Gilching (DE); Georg Zettl, Pilsting (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/966,543

(22) PCT Filed: Mar. 11, 2019

(86) PCT No.: PCT/EP2019/055980

§ 371 (c)(1),
(2) Date: Jul. 31, 2020

(87) PCT Pub. No.: WO2019/197094

PCT Pub. Date: Oct. 17, 2019

(65) Prior Publication Data

US 2021/0046535 A1 Feb. 18, 2021

(30) Foreign Application Priority Data

Apr. 10, 2018 (DE) ..... 10 2018 205 350.2

(51) Int. Cl.
*B21D 22/30* (2006.01)
*B21D 22/02* (2006.01)
(Continued)

(52) U.S. Cl.
CPC ..... *B21D 22/30* (2013.01); *B21D 53/88* (2013.01); *B21D 22/02* (2013.01); *B21D 22/06* (2013.01); *B21D 22/20* (2013.01); *B21D 37/10* (2013.01)

(58) Field of Classification Search
CPC ..... B21D 22/02; B21D 22/06; B21D 22/20; B21D 22/26; B21D 22/30; B21D 53/88;
(Continued)

(56) References Cited

U.S. PATENT DOCUMENTS 3,542,249 A * 11/1970 Martin ..... B21D 22/00 72/354
2004/0148997 A1 8/2004 Amino et al.
2021/0220897 A1* 7/2021 Sawa ..... B21D 53/88

FOREIGN PATENT DOCUMENTS

CN 106391815 A * 2/2017 ..... B21D 22/06
CN 107321846 A 11/2017
(Continued)

OTHER PUBLICATIONS

International Search Report (PCT/ISA/210) issued in PCT Application No. PCT/EP2019/055980 dated Jun. 25, 2019 with English translation (four (4) pages).
(Continued)

*Primary Examiner* — Debra M Sullivan
*Assistant Examiner* — Matthew Stephens
(74) *Attorney, Agent, or Firm* — Crowell & Moring LLP

(57) ABSTRACT

A shaping tool and a method are provided for producing an edge on a part. A first and a second shaping component are moveable from an open position into a shaping position, as a result of which, in a pressing region of the shaping tool, the part, which can be supported on both shaping components while it is moved in the pressing region, can be pressed into a negative mold, formed in the second shaping component, for the edge that is to be produced. A shaping surface of the first shaping component in the pressing region has an allowance element which projects over base surface regions
(Continued)

of the shaping surface adjacent to the allowance element, as a result of which the part can be distanced from the second shaping component at least in the shaping position in a sub-region adjacent to the pressing region.

3 Claims, 1 Drawing Sheet

(51) Int. Cl.

| | |
|---|---|
| ***B21D 22/06*** | (2006.01) |
| ***B21D 22/20*** | (2006.01) |
| ***B21D 37/10*** | (2006.01) |
| ***B21D 53/88*** | (2006.01) |

(58) Field of Classification Search
CPC ..... B21D 37/10; B21D 37/12; B21D 53/92; B21D 22/04
See application file for complete search history.

(56) References Cited

FOREIGN PATENT DOCUMENTS

| | | | | | |
|---|---|---|---|---|---|
| CN | 107666974 | A | | 2/2018 | |
| DE | 10 2011 115 219 | A1 | | 3/2013 | ..... B21D 22/20 |
| DE | 102011115219 | A1 | * | 3/2013 | ..... B21D 22/20 |
| DE | 10 2013 007 352 | A1 | | 10/2014 | |
| DE | 102013007352 | A1 | * | 10/2014 | ..... B21D 22/26 |
| DE | 10 2013 019 634 | A1 | | 5/2015 | |
| DE | 10 2014 216 503 | A1 | | 2/2016 | |
| DE | 10 2014 221 878 | A1 | | 4/2016 | |
| DE | 10 2014 017 920 | A1 | | 6/2016 | |
| DE | 102014017920 | A1 | * | 6/2016 | ..... B21D 22/02 |
| FR | 3 014 712 | A1 | | 6/2015 | |
| FR | 3014712 | A1 | * | 6/2015 | ..... B21D 22/20 |
| JP | 2007-83296 | A | | 4/2007 | |
| JP | 4483933 | B2 | * | 6/2010 | ..... B21D 22/06 |

OTHER PUBLICATIONS

German-language Written Opinion (PCT/ISA/237) issued in PCT Application No. PCT/EP2019/055980 dated Jun. 25, 2019 (eight (8) pages).

German-language Search Report issued in German Application No. 10 2018 205 350.2 dated Mar. 15, 2019 with partial English translation (15 pages).

Chinese Office Action issued in Chinese application No. 201980012557.8 dated Sep. 1, 2021 (Ten (10) pages).

* cited by examiner

SHAPING TOOL, METHOD FOR PRODUCING AN EDGE ON A COMPONENT, AND METHOD FOR PRODUCING A SHAPING TOOL OF THIS KIND

BACKGROUND AND SUMMARY OF THE INVENTION

The invention relates to a shaping tool for producing an edge on a part. Furthermore, the invention relates to a method for producing an edge on a part. In addition, the invention relates to a method for producing such a shaping tool.

An appearance of a motor vehicle is decisively influenced by a geometry of outer skin parts of the motor vehicle which are nowadays customarily produced by means of a shaping, for example, of fine aluminum or steel sheets having an initial thickness. In particular, these outer skin parts can have at least one bend with a particularly small radius, a so-called sheet-metal shaped part edge or sharp edge. Such a bend in a visible region of the outer skin part is referred to as a sheet-metal shaped part edge. The sheet-metal shaped part edge typically runs or extends in a freeform surface region of the outer skin part. In addition, the sheet-metal shaped part edge can, on the one hand, have a design function, for example can form a so-called character edge. Alternatively or in addition, the sheet-metal shaped part edge can have a technical function, for example provide the outer skin part with a particularly high resistance to bending. In series vehicle construction, producing such sheet-metal shaped part edges, in particular by means of shaping, for example deep-drawing, proves to be particularly demanding since the particularly small radii required to form the sheet-metal shaped part edge are particularly difficult to produce by means of shaping or deep-drawing.

For process-related reasons, shaping or deep-drawing of sheet-metal parts results in a reduction in a part thickness or sheet-metal thickness, especially in a region where a sheet-metal shaped part edge is intended to be formed. Normally, in a curved tool region, a convex tool surface predetermines a geometry of the part on a concave part side. On a convex part side opposite to the concave part side, the reduction in the sheet-metal thickness in the region of the sheet-metal shaped part edge has the effect that the radius of the sheet-metal shaped part edge is different from a sum formed by the sheet-metal thickness and the radius of the convex tool surface. Furthermore, it is particularly difficult, in particular impossible, to reproduce or control the radius of the sheet-metal shaped part edge produced in a conventional manner, such that one or more character or sheet-metal shaped part edges whose respective profiles are intended to transition into one another on a common polyline over two or more mutually adjacent sheet-metal parts produced separately from one another (for example over a side wall and over an adjacent door or over two mutually adjacent doors, etc.) can be offset from one another.

Approaches as to how a particularly sharp-edged sheet-metal shaped part edge can be produced are already known from the prior art, in particular from series vehicle construction. Thus, for example, DE 10 2013 019 634 A1 discloses a method for producing a sheet-metal shaped part by shaping a sheet-metal material, wherein at least one sheet-metal shaped part edge is created on a sheet-metal preform by local electromagnetic post-shaping of the sheet-metal material. However, such an approach requires a particularly high amount of energy.

DE 10 2014 017 920 A1 discloses a method for producing a sheet-metal shaped part having at least one sharp-edged sheet-metal shaped part edge by multistage shaping of a sheet-metal material. This involves first shaping the sheet-metal material in a first press-bound shaping tool, wherein the sheet-metal shaped part edge to be produced is pre-shaped with an increased edge radius and with a camber. This is then followed by further shaping of the sheet-metal material in a second press-bound shaping tool, wherein the preshaped camber is reduced and the sheet-metal shaped part edge is fully formed. Here, the time required to produce the sharp-edged sheet-metal shaped part edge is particularly long, since this method comprises two individual steps to be carried out one after the other.

Moreover, DE 10 2013 007 352 A1 discloses a method for forming an edge on a sheet-metal body part for a motor vehicle, wherein the sheet-metal part is shaped between a die, which predetermines the shape and the profile of the edge to be formed, and a punch in a deep-drawn operation in the region of the edge to be formed, wherein, during the deep-drawing operation, the side of the sheet-metal part opposite to the edge to be formed has a notch following the profile of the edge stamped into it with a stamping radius which is larger than the radius of the edge to be formed. Here, a particularly high shaping force has to be applied to the sheet-metal body part by means of the punch and the die in order, by means of the notch, to form the desired edge on the sheet-metal body part. Furthermore, in this method, the sheet-metal body part bears against both tools, that is to say against the die and also against the punch, in each case over a particularly large area, which leads to a particularly large-area thinning of a material of the sheet-metal body part.

The object on which the present invention is based is to provide a device and a method in order to be able to particularly efficiently create an especially particularly sharp edge with a particularly small radius on a part. Furthermore, a particularly advantageous method for creating such a shaping tool is to be provided.

This object is achieved by a shaping tool and by a method for producing an edge on a part, according to the claimed invention. Moreover, the object is achieved by a method for creating such a shaping tool according to the claimed invention. Advantages and advantageous embodiments of the shaping tool according to the invention are to be considered as advantages and advantageous embodiments of the methods according to the invention, and vice versa.

According to the invention, a shaping tool for producing an edge on a part is provided, having a first shaping component and having a second shaping component corresponding thereto. The two shaping components can be moved from an open position, in which the shaping tool can be charged with the part, into a shaping position. This means that the part to be deformed can be fed to the shaping tool in the open position, such that the component can be arranged, in particular fastened, in the shaping tool, in particular between the two shaping components. Since the two shaping components can be moved from the open position into the shaping position, in a pressing region of the shaping tool, the part, which can be supported on both shaping components during the movement in the pressing region, can be pressed into a negative mold, which is formed in the second shaping component, of the edge to be produced. In other words, in the shaping position in the pressing region, the part in each case directly adjoins both shaping components.

In order then to be able to particularly efficiently create an edge on the part, there is provision that a shaping surface of the first shaping component has, in the pressing region, an allowance element which projects beyond base surface regions of the shaping surface which adjoin the allowance element, with the result that, at least in the shaping position, the part can be spaced apart from the second shaping component in a subregion adjoining the pressing region. In other words, the shaping surface is formed from the base surface region and the allowance element, wherein the allowance element is arranged at least substantially in the pressing region. In the pressing region, the shaping surface of the first shaping component, by virtue of the allowance element there, is arranged closer to the second shaping component than the base surface regions adjoining the allowance element. This means that, starting from the base surface regions of the first shaping component, the allowance element projects from the first shaping component in the direction of the second shaping component.

The pressing region is to be understood as meaning a region of the shaping tool, in particular between the two shaping components, in which the part experiences a bilateral tool contact in order to be cold-forged by means of the two tool components. Expressed in other terms, the part is for example squashed or compressed in the pressing region.

Some advantages are afforded by the fact that, during movement of the two shaping components from their open position into their shaping position, a situation is prevented in which the part comes, outside of the pressing region, into direct contact with the first and the second shaping components. Thus, for example, it is possible for a bilateral tool contact of the part to be avoided outside of or away from the pressing region during the movement of the shaping components, such that an extrusion or cold-forging of the part occurs only or exclusively in the pressing region, where, in the shaping position, a relatively narrow gap can be set between the two shaping components, with the result that the cold-forging occurs. It is possible in this way to keep particularly low a degree of wear of the shaping tool and/or its shaping components used for the manufacture of the part, since they are only subjected to particularly small process forces. This results, on the one hand, in a particularly long service life of the shaping tool and of the shaping components right through to a press by means of which the shaping tool can be driven. Given the particularly small process forces, the press can be operated in a particularly energy-efficient manner.

There further results a particularly good reproducibility of the edge which is or can be created by means of the shaping tool, such that an edge, in particular a character edge of a motor vehicle, which runs over at least two mutually adjacent outer skin parts, for example over a fender and an adjacent vehicle door, can be created to be particularly true to shape. By virtue of the particularly reliably reproducible edge, the profile of the character edge over the mutually adjacent outer skin parts is then particularly constant, continuous and free from disturbing, discontinuous transitions.

It has been found to be particularly advantageous for the allowance element to have a radius which is smaller than an inner radius of the negative mold. This makes it possible for the pressing region to be designed to be particularly small, such that, in the shaping position, the part, with respect to the shaping surface, can be spaced apart from the second shaping component in a particularly large region. Since the radius of the allowance element is smaller than the inner radius of the negative mold, this results in the radius of the allowance element being smaller than an outer radius of the edge to be created. The edge to be created can be formed by means of the shaping tool on a visible side of the part.

The first shaping component can take the form of a punch, and the second shaping component can take the form of a die. In other words, the shaping tool has the first shaping component taking the form of the punch and the second shaping component taking the form of the die. This means that the shaping tool can be, for example, a deep-drawing machine by means of which the part to be shaped is to be provided with the edge in a particularly efficient manner. The deep-drawing machine or the shaping tool can be operated hydraulically and/or pneumatically and/or electromechanically.

The invention further relates to a method for producing an edge on a part by means of a shaping tool. In particular, the shaping tool which is used in the method can be the above-described shaping tool. In the method, a first shaping component, in particular the above-described first shaping component and a second shaping component corresponding thereto, in particular the above-described second shaping component, of the shaping tool are moved from an open position into a shaping position. In the open position, the shaping tool is charged with the part, that is to say that, in the open position, the component to be deformed on which the edge is to be formed is provided or fed to the shaping tool, such that the part can subsequently be processed, in particular shaped, by means of the shaping tool. By means of the movement of the two shaping components from their open position into their shaping position, in a pressing region, in particular in the above-described pressing region, of the shaping tool, the part, which is supported on both shaping components during the movement in the pressing region, is pressed into a negative mold, which is formed in the second shaping component, in particular into the above-described negative mold, of the edge to be produced. In order then to be able to particularly efficiently create the edge on the part, there is provision in the method according to the invention that a shaping surface, in particular the above-described shaping surface, of the first shaping component has, in the pressing region, an allowance element, in particular the above-described allowance element, which projects beyond base surface regions adjoining the allowance element, in particular the above-described base surface regions, of the shaping surface, with the result that, at least in the shaping position, the part is spaced apart from the second shaping component in a subregion, in particular the above-described subregion, adjoining the pressing region.

The invention further relates to a method for creating a shaping tool, in particular the above-described shaping tool, for producing an edge, in particular the above-described edge, on a part, in particular on the above-described part, comprising the following steps. In a first step, a first shaping component, in particular the above-described first shaping component, and a second shaping component corresponding thereto, in particular the above-described second shaping component, are created. The two shaping components can be moved from an open position, in particular the above-described open position, in which the shaping tool can be charged with the part, into a shaping position, in particular the above-described shaping position. By means of the movement or as a result of the movement of the shaping components from their open position into their shaping position, the part, which is held in a pressing region, in particular the above-described pressing region, of the shaping tool between the two shaping components and can be or is supported on both shaping components during the movement in the pressing region, can be pressed into a negative mold, which is formed in the second shaping component, in particular into the above-described negative mold, of the edge to be produced.

In a second step of the method, an original base surface of the first shaping component is created.

In a further, third step, the allowance element of the first shaping component is created in the pressing region, wherein the allowance element is spaced apart from the original base surface.

In a further, for example, fourth step, a shaping surface of the first shaping component is created, wherein the shaping surface comprises the allowance element arranged in the pressing region and adjoining base surface regions of the original base surfaces which are connected to the allowance element, such that the allowance element projects beyond the adjoining base surface regions. It is possible in this way for the part, at least in the shaping position, to be spaced apart from the second shaping component in a subregion joining the pressing region.

By means of this method there is provided a particularly advantageous method for creating a shaping tool, in particular the above-described shaping tool, since the shaping surface is locally modified by means of the allowance element of the first shaping component, with the result that the pressing region is designed to be particularly small. A particularly small pressing region is advantageous since—as already described above—a particularly small process force is necessary during the production of the edge by means of the shaping tool, with the result that the shaping tool can be operated in a particularly energy-efficient manner.

It has been found to be particularly advantageous that an original allowance surface of the allowance element is created whose shape, dimensions and profile correspond to those of a portion of the base surface, from which portion the allowance element having the original allowance surface is displaced, that is to be say offsetted, in a space-parallel manner. Expressed in other terms, a portion of the original base surface of the first shaping surface is copied during the creation of the shaping tool, such that the copy of the portion has a geometry which corresponds at least substantially to a geometry of the original portion of the base surface. The copy of the portion of the base surface, which portion is the original allowance surface of the allowance element, is then displaced in a space-parallel manner with respect to the original portion of the base surface from which the copy originates. Between points, in particular spatial points of the copied portion and corresponding (spatial) points of the original portion there in each case arises, during or as a result of the offsetting, a vector which is perpendicular to the portion of the original base surface and to the copied portion. The vectors in this case are of uniform length. The allowance element can thus be created in a particularly simple manner.

At least one dimension of the original allowance surface can be changed by at least one modification dimension, with the result that a final allowance surface of the allowance element is created from the original allowance surface. In particular, a radius of the particular allowance surface can be changed by means of the at least one modification dimension, for example in such a way that said radius is larger than a radius of the portion of the base surface from which the original allowance surface originates. Furthermore, it is possible for example for an arc of the original allowance surface to be compressed, in particular where the arc length is at least substantially constant, subsequently resulting in a radius for the original allowance element that is smaller than the radius of the portion of the base surface from which the original allowance surface originates. This means that the radius of the final allowance surface that is changed by means of the at least one modification dimension can in particular be the above-described radius of the allowance element that is smaller than an inner radius of the negative mold. There can be provided still further modification dimensions by means of which or on the basis of which for example an arc length, a radius origin position, etc., are changed. It is thus possible in a particularly simple manner and/or with little effort to create or construct the final allowance element to suit the requirements, that is to say adapted to the desired edge of the part.

It is particularly advantageous if the base surface regions and the allowance surface transition continuously into one another via respective transition surfaces. In particular, a respective transition surface can transition continuously into the corresponding base surface region and/or the allowance surface. It is for example conceivable that the respective transition surface transitions with a continuous tangent into the corresponding base surface region and/or the allowance surface. The fact that the respective transition surfaces are formed continuously or homogeneously ensures that the part processed or shaped by means of the two shaping components is not subjected to any spatially particularly confined loading, for example with a notch effect, whereby the part would become weakened.

A respective sheet-metal shaped part edge or character edge, that is to say also the edge described herein, are in fact defined or formed by a freeform surface or a plurality of freeform surfaces, whereas reference is made to radii with regard to a particularly simple description of the invention. It should be understood in this connection that this invention is not limited to pure radii but can equally be applied to freeform surfaces, wherein the respective freeform surfaces which define the edge can have at least one radius or a plurality of radii.

Further features of the invention will emerge from the claims, the figures and the description of the figures. The features and combinations of features stated above in the description and the features and combination of features stated below in the description of the figures and/or shown in the figures alone can be used not only in the respectively specified combination but also in other combinations or in isolation.

A shaping tool according to the invention for producing an edge on a part, a method according to the invention for producing an edge on a part, and a method according to the invention for creating a shaping tool will now be explained jointly in more detail on the basis of a respective preferred exemplary embodiment and with reference to the drawings.

BRIEF DESCRIPTION OF THE DRAWINGS

In the figures, identical or functionally identical elements are provided with the same reference signs.

DETAILED DESCRIPTION OF THE DRAWINGS

Figure 1:
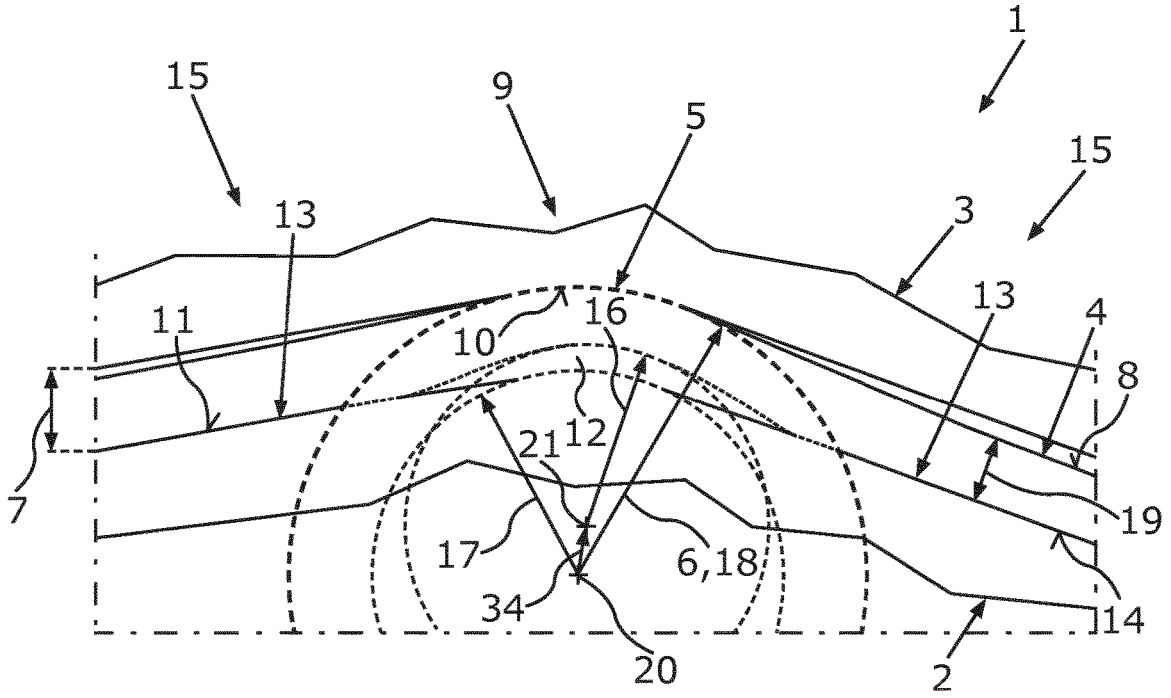
FIG. 1 is a schematic sectional illustration showing a shaping tool having a first and a second shaping component and a part.

FIG. 1 is a schematic illustration showing a shaping tool 1 having a first shaping component 2 particularly taking the form of a punch and a second shaping component 3 particularly taking the form of a die. Between the two shaping components 2, 3 there is arranged a part 4 which is intended to be provided with an edge 5 by means of the shaping tool 1. The edge 5 is a curvature with a particularly small radius, for example an edge radius 6. If the part 4 is an outer skin part of a motor vehicle, a particular, for example sporty, character can be given to the appearance of the motor vehicle by means of the edge 5. This means that the edge 5 is a so-called character edge. Furthermore, the edge 5 can have a technical function, for example serve as a drainage device for water channeled along the outer skin of the motor vehicle. Such a character edge can extend on the outer skin of the motor vehicle over a plurality of mutually adjacent outer skin parts, and therefore a high degree of reproducibility when producing the edge 5 is desirable. In other words, it is desirable that, in the case of a multiplicity of edges 5 being produced, in particular in a series production, the respective edges 5 in each case follow as exactly as possible a production specification of the edge 5.

The first shaping component or the punch 2 and the second shaping component or die 3 correspond to one another, for example in such a way that the punch 2 can at least partially engage in the die 3. The shaping tool 1 can be for example a deep-drawing machine by means of which the part 4 can be deformed or shaped.

The first and the second shaping component 2, 3 or the punch 2 and the die 3 can be moved into an open position in which the shaping tool 1 can be charged with the part 4. The part 4 is for example a sheet-metal part which can be shaped by means of the shaping tool 1 or which can be provided with the edge 5 by means of the shaping tool 1. This means that, in the present case, the part 4, in order to be able to be shaped by means of the shaping tool 1, is to be arranged, for example clamped in, between the punch 2 and the die 3, for which purpose the two shaping components 2, 3 can be moved into the open position. In the open position, a distance 7 between the punch 2 and the die 3 is designed to be particularly large, such that it is possible in a particularly simple manner for the part 4 to be provided to the shaping tool 1. For example, the sheet-metal part 4 can be placed between the punch 2 and the die 3 into the shaping tool 1 at least partially automatically and/or manually. The shaping tool 1 can have a holding device known per se by means of which the part 4 placed into the shaping tool 1 can be held and/or clamped in the shaping tool 1 in a positionally fixed manner.

The two shaping components 2, 3 or the punch 2 and the die 3 can be moved from the open position into a shaping position. Since the part 4 is arranged or held between the punch 2 and the die 3 during this movement of the two shaping components 2, 3 from their open position into their shaping position, it is possible for the part 4 to be shaped by virtue of the movement or as a result of the movement of the two shaping components 2, 3 from their open position into their shaping position. A shape or geometry which corresponds at least substantially to a geometry of the punch or the first shaping element 2 is customarily imparted to the part 4 held between the punch 2 and the die 3 during the movement of the two shaping components 2, 3 from their open position into their shaping position, i.e., during a shaping process, in particular deep-drawing process. Here, the for example metallic and/or plastic-containing part 4 comes primarily into direct contact with the punch 2. In other words, a geometry of the die 3 is configured in such a way that, after the movement, the part 4 has a desired shape, in particular the desired edge 5, on a visible side 8 of the part that faces away from the punch 3. This means that, during a conventional production of the edge 5, the part 4 is subjected only to a pure deep-drawing operation, but this operation has particularly high result fluctuations on account of its principle. In other words, the edge 5 produced by pure deep-drawing is reproducible to a particularly poor degree, since there occurs, mainly in the region of the edge 5, an expansion and consequently a thinning of a material thickness of the part 4. There is therefore provision to support the part 4 in a pressing region 9 on the punch 2 and on the die 3, that is to say on both shaping components 2, 3, and to press it into a negative mold 10, which is formed in the die 3, of the edge 5 to be produced. This means that the shaping of the part 4 by means of the shaping tool 1 comprises compression mold and/or extrusion or cold-forging.

In order then to give the edge 5 a particularly small edge radius 6 in a particularly efficient manner, a shaping surface 11 of the die 2 has, in the pressing region 9, an allowance element 12 which laterally projects beyond base surface regions 13 of the shaping surface 11 which adjoin the allowance element 12. The allowance element 12, which can also be referred to as a cold-forging strip or prominent strip, forms a projection of the shaping surface 11 or of the punch 2. During the movement of the two shaping components 2, 3 from their open position into their shaping position, the shaping surface 11 of the punch 2 is in direct contact with the part 4 to be shaped. This means that an inner side 14 of the part 4, opposite the visible side 8 of the part, is situated opposite to and directly adjoins the shaping surface 11 of the punch 2.

By virtue of the allowance element 12 which projects beyond the shaping surface 11, the part 4, at least in the shaping position, can be spaced apart from the die 3 in a subregion 15 adjoining the pressing region 9. In other words, the pressing region 9 is a locally delimited region of the shaping tool 1, such that the part 4 away from the pressing region 9 in the shaping position is in direct contact with only one of the two shaping components 2, 3, in particular only with the punch 2. This is therefore advantageous, inter alia, since a pressing force which is to be applied to produce the edge 5 and by means of which the punch 2 and the die 3 are moved or adjusted in their shaping position is less than in the case of a conventional shaping tool without the allowance element 12, in which tool the part to be shaped is in bilateral contact with the two shaping components over a particularly large area, that is to say also outside of the pressing region 9.

In the present case, the allowance element 12 has an allowance radius 16 which is designed to be smaller than a base surface radius 17. Consequently, the allowance radius 16 is substantially smaller than an inner radius 18 of the negative mold 10, wherein the inner radius 18 and the edge radius 6 can at least substantially correspond. By virtue of the particularly small allowance radius 16, the part 4 held between the two shaping components 2, 3 can be pressed into the pressing region 9 in a locally limited manner as a result of the movement of the two shaping components or of the punch 2 and the die 3 in their shaping position.

The desired edge radius 6 is customarily composed of the base surface radius 17 and of a material thickness or sheet-metal thickness 19 of the part 4 to be deformed. Since the allowance radius 16 is smaller than the inner radius 18 of the negative mold 10, the allowance radius 16 can be smaller than a difference formed from the desired edge radius 6 and a fraction of the material thickness 19. This is advantageous insofar as a distance between the negative mold 10 and the first shaping component 2 or its allowance element 12 is then less than the material thickness 19 in the shaping position in the pressing region 9, such that the part 4 to be shaped can be pressed into the negative mold 10 in a particularly efficient manner.

It can furthermore be seen in FIG. 1 that a radius origin 20 of the edge radius 6 or of the inner radius 18 of the negative mold 10 and a further radius origin 21 of the allowance radius 16, which is different from the radius origin 20, can be divergent.

In a method according to the invention for producing the edge 5 on the part 4 by means of the shaping tool 1, the punch 2 and the corresponding die 3 of the shaping tool 1 are moved from the open position, in which the shaping tool 1 is charged with the part 4, into the shaping position, with the result that, in the pressing region 9 of the shaping tool 1, the part 4, which is supported on the punch 2 and on the die 3 during the movement into the pressing region 9, is pressed into the negative mold 10, which is formed in the die 3, of the edge 5 to be produced. In order to form or produce the edge 5 on the part 4 in a particularly efficient manner, the shaping surface 11 of the punch 2 has, in the pressing region 9, the allowance element 12 which projects laterally beyond base surface regions 13 of the shaping surface 11 which adjoin the allowance element 12, with the result that, at least in the shaping position, the part 4 is spaced apart from the die 3 in the subregions 15 adjoining the pressing region 9.

The advantages and/or embodiments or developments described in conjunction with the shaping tool 1 according to the invention apply without restriction to the method according to the invention for creating the edge 5 on the part 4, and vice versa.

A subregion 15 or a plurality of subregions 15 can directly laterally adjoin the pressing region 9. The respective subregion 15 and the pressing region 9 can each transition into one another without an abrupt, for example discontinuous or nonhomogeneous, transition having to be made between the respective subregion 15 and the pressing region 9.

Figure 2:
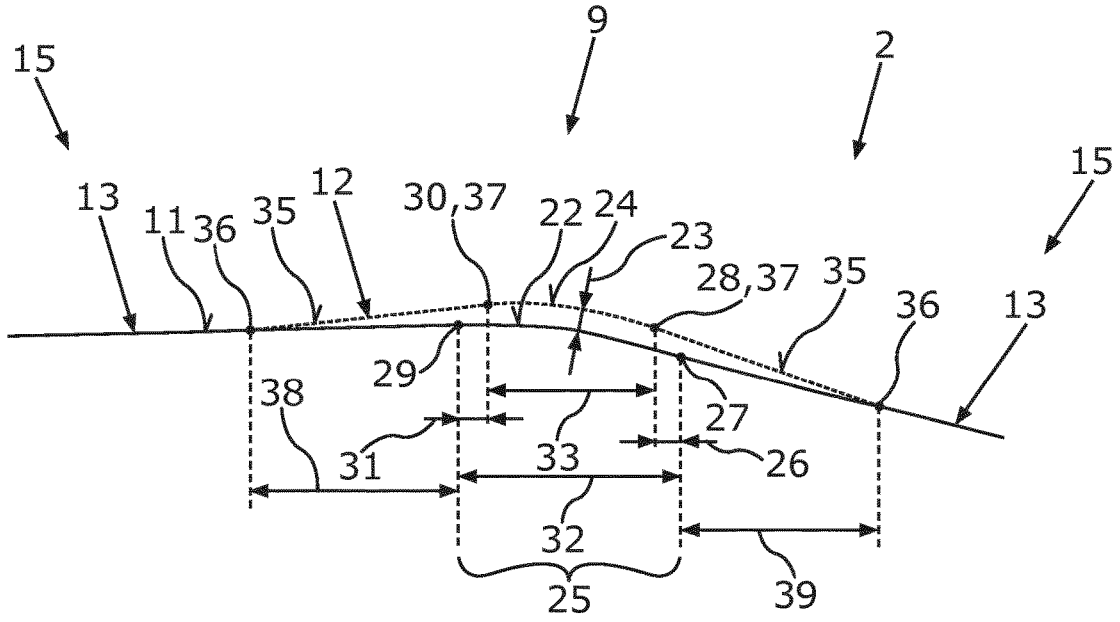
FIG. 2 is a schematic illustration, for illustrating a method for creating the shaping tool, showing a shaping surface and an allowance element of the first shaping component.

In order to create the shaping tool 1 in a particularly advantageous manner, a method for producing the shaping tool 1 is proposed according to the invention. For this purpose, reference is made to a combination of FIG. 1 and FIG. 2 in which, to illustrate the method for creating the shaping tool 1, the shaping surface 11 and the allowance element 12 of the punch 2 are shown in a schematic illustration. In a first step of the method, the punch 2 and the die 3 corresponding thereto are created. The pressing region 9 is created during the creation or by means of the creation of the two shaping components 2, 3 and is formed by geometries of the punch 2 and die 3 which correspond to one another. Furthermore, the negative mold 10 is created on or in the die 3 and, when pressing the part 4 into the negative mold 10, gives the edge 5 an edge geometry, in particular the edge 5.

When creating the punch 2, an original base surface 22 of the punch 2 is created. This original base surface 22 can be regarded as a virtual building block of the punch 2, since, in a further step of the method, the allowance element 12 of the punch 2 is created, wherein the allowance element 12 is arranged in the pressing region 9. The allowance element 12 is spaced apart from the original base surface 22 by a distance 23.

The method further comprises creating the shaping surface 11 of the first shaping component 2, wherein the shaping surface 11 comprises the allowance element 12 arranged in the pressing region 9 and adjoining base surface regions 13 of the original base surface 22 which are connected to the allowance element 12. Since the allowance element 12 is spaced apart from the original base surface 22 by the distance 23, the allowance element 12 projects laterally beyond the adjoining base surface regions 13, with the result that, at least in the shaped position, the part 4 can be spaced apart from the die 3 in the subregion 15 adjoining the pressing region 9.

In other words, the shaping surface 11 of the first shaping component 2 or of the punch 2 is respectively proportionally formed by the base surface regions 13 and an allowance surface 24 which is spaced apart from the original base surface 22 by the distance 23. Expressed in other terms, a respective base surface region 13 and the allowance surface 24 each transition into one another, in particular seamlessly.

The allowance surface 24 of the allowance element 12 can be created for example by creating an original allowance surface whose geometry, that is to say whose shape, dimensions and/or profile, corresponds to a geometry of a portion 25 of the base surface 22. In other words, there can be provision when creating the allowance surface 24 to copy the portion 25 of the base surface 22. The copy of the portion 25 is then identical to the original allowance surface of the allowance element 12 and, when creating the allowance surface 24 of the allowance element 12, this copy of the original allowance surface is displaced or offsetted in a space-parallel manner in relation to the original portion 25 of the base surface 22. Accordingly, the respective geometry of the portion 25 and that of the original allowance surface 24 are congruent to one another, with a respective vector running between points, for example spatial points, of the portion 25 and (spatial) points of the original allowance surface 24. A respective vector is then perpendicular to the portion 25 and to the original allowance surface 24.

For example, the offsetting of the original allowance surface of the allowance element 12 with respect to the portion 25 of the base surface 22 can comprise a space-parallel displacement by the distance 23.

In order to be able to form the allowance radius 16 to be particularly small, the creation of the allowance element 12 can comprise changing at least one dimension of the original allowance surface by at least one modification dimension 26. This results in the final allowance surface 24 of the allowance element 12 being created from the original allowance surface. For example, a first end 27 of the original allowance surface and a first end 28 of the final allowance surface 24 can be spaced apart from one another by the modification dimension 26. Analogously, a second end 29 of the original allowance surface and a second end 30 of the final allowance surface 24 can be spaced apart from one another by a modification dimension 31. This means that a length 32 of the original allowance surface or of the portion 25 of the original allowance surface and a length 33 of the final allowance surface 24 are designed to be different. It is particularly preferred if the modification dimension 26 and the modification dimension 31 are designed to be at least substantially equal.

As has already been described in conjunction with FIG. 1, the respective radius origins 20, 21 can diverge. This means that the two radius origins 20, 21 can be spaced apart from one another by a modification dimension 34 or by a modification vector 34. It should be understood that, although the modification dimensions 26, 31, 34 can be presented as only two-dimensional in FIG. 1 and FIG. 2, the modification dimensions 26, 31, 34 can in fact each take the form of a three-dimensional modification vector. It is conceivable here that one or more of the modification vectors 26, 31, 34 can result by one or more of the other modification vectors 26, 31, 34 being actively changed. With particular preference, the modification vector 34 by means of which the two radius origins 20, 21 are spaced apart from one another results from a change of the modification vectors 26 and/or 31.

The creation of the allowance element 12 can further comprise creating transition surfaces 35 which are each arranged between a respective base surface region 13 and the allowance surface 24, such that a respective base surface region 13 and the allowance surface 24 continuously transition into one another via the respective transition surfaces 35. This effectively prevents a situation in which the part 4 to be shaped is notched in the pressing region 9 by means of the allowance element 12 of the shaping tool 1, with the result that the shaped part 4 is particularly stable and has no surface defect. A respective end 36, which is remote from the allowance surface 24, of the respective transition surface 35 lies on the original base surface 22 or on a respective base surface region 13. A respective end 37 arranged close to the allowance surface 24 is in each case coincident with the first end 28 or with the second end 30 of the allowance surface 24. The transition surfaces 35 can be designed to be at least substantially flat or planar. It is equally fully conceivable that the respective transition surfaces 35 have a respective curvature in order to ensure a particularly continuous transition between the base surface regions 13 and the transition surfaces 35 or between the transition surfaces 35 and the allowance surface 24. The allowance element 12 thus accordingly comprises the first transition surface 35 which adjoins the base surface region 13 at the end 36. Furthermore, the allowance element 12 comprises the allowance surface 24 which adjoins the first transition surface 35 and which is adjoined by the second transition surface 35 which again transitions into the base surface region 13 at its end 36. The original base surface 22 of the punch 2 is accordingly locally modified or increased by means of the allowance element 12. This local modification or increase occurs over a length of the original base surface 22 that is composed of a length 38 of the first transition surface 35, the length 32 of the original allowance surface and a length 39 of the further transition surface 35.

Alternatively or additionally, a geometry and/or a position of the allowance element 12 can be changed by means of changing or varying the distance 23, the length 38 and/or the length 39. This means that the distance 23 and the lengths 38, 39 can each be considered as a modification dimension.

What is to be understood by creation herein is at least the setting-up of a construction plan for the above-described elements, for example the shaping component 2, 3, the base surface 22, the allowance element 12, the shaping surface 11, etc. The construction plan particularly takes the form of a geometric dataset which can be processed and/or further processed by means of electronic data processing. Furthermore, the creation of those elements, for example in a final method step, can comprise an actual production or fabrication of those elements, in particular operations of primary forming, shaping, separating, adjoining, coating and/or changing material properties, etc.

Overall, the invention shows how the edge 5 with the particularly small edge radius 6 can be produced more efficiently by contrast with conventional shaping tools in which shaping components are globally and/or constantly offsetted with respect to one another. For example, the edge radius 6 can stem from a value range from 1 mm to 20 mm, preferably 10 mm to 12 mm, particularly preferably 4 mm to 8 mm. It should be taken into consideration that a smallest possible edge radius 6 corresponds at least to the material thickness 19 of the part to be shaped.

By means of the shaping tool 1 according to the invention or by means of the method according to the invention for producing the edge 5 on the part 4 and by means of the method according to the invention for creating the shaping tool 1, it is possible in a particularly advantageous manner for a punch geometry in the region of character edges on outer skin parts for motor vehicles to be locally modified or locally elevated. This local modification or local elevation occurs in particular on the basis of a thinning of the part 4 in the region of the edge radius 6, with this thinning being able to be determined for example by means of simulations and/or measurements. Furthermore, at least one material parameter (type, toughness, hardness, etc.) of the part 4 and/or a starting sheet-metal thickness can be included in the local modification of the punch surface. By way of the allowance element 12, the part 4 is pressed into the die 3 via the punch 2. The die 3 thus predetermines a geometry of the visible side 8 of the part. In order to produce sufficient pressing of the part 4 in the die 3, an embodiment of the allowance element 12 is selected in such a way that a distance between the two shaping components 2, 3 in the pressing region 9 is slightly smaller than the starting sheet-metal thickness or the material thickness 19 of the part 4. In other words, a height of the allowance element 12 is to be designed, by comparison with a thickness of the part 4 in the pressing region 9 that is reduced on account of local thinning during shaping, to be slightly greater, for example by a fraction of the material thickness or of a sheet-metal thickness of the part to be shaped, or to be equal. Here, the local thinning has been simulated using a conventional shaping tool, that is to say without an allowance element 12.

As a departure from the prior art, shaping of the visible side 8 of the part does not occur in an undefined manner by way of only the punch 2, but in a defined manner on both sides by way of both shaping components 2, 3, that is to say by way of the punch 2 and the die 3. By using the punch-side allowance element 12 it is thus possible to generate a defined or predetermined edge radius 6 on the visible side 8 of the part, with this radius ideally corresponding to a die radius or the inner radius 18 of the negative mold 10 of the die.

LIST OF REFERENCE SIGNS

1 Shaping tool
2 First shaping component
3 Second shaping component
4 Part
5 Edge
6 Edge radius
7 Di stance
8 Visible side of the part
9 Pressing region
10 Negative mold
11 Shaping surface
12 Allowance element
13 Base surface region
14 Inner side
15 Subregion
16 Allowance radius
17 Base surface radius
18 Inner radius
19 Material thickness
20 Radius origin
21 Radius origin
22 Base surface
23 Distance
24 Allowance surface
25 Portion
26 Modification dimension

27 End
28 End
29 End
30 End
31 Modification dimension
32 Length
33 Length
34 Modification dimension
35 Transition surface
36 End
37 End
38 Length
39 Length

What is claimed is:

1. An apparatus, comprising:

a shaping tool that includes a first shaping component and a second shaping component; and a sheet-metal part disposed in the shaping tool;

wherein a shaping surface of the first shaping component has in a pressing region an allowance element which projects beyond base surface regions of the shaping surface which adjoin the allowance element;

wherein a negative mold is formed in the second shaping component;

wherein the allowance element has an allowance radius, wherein the negative mold has an inner curved surface with a radius, and wherein the allowance radius of the allowance element is smaller than the radius of the inner curved surface of the negative mold;

wherein when the allowance element is pressed into the negative mold the sheet-metal part is spaced apart from the second shaping component in a subregion adjoining the pressing region.

2. The apparatus according to claim 1, wherein the first shaping component takes the form of a punch, and the second shaping component takes the form of a die.

3. A method of producing an edge on a sheet-metal part by use of a shaping tool, wherein the shaping tool includes:

a first shaping component and a second shaping component;

wherein a shaping surface of the first shaping component has in a pressing region an allowance element which projects beyond base surface regions of the shaping surface which adjoin the allowance element;

wherein a negative mold is formed in the second shaping component for producing the edge;

wherein the allowance element has an allowance radius, wherein the negative mold has an inner curved surface with a radius, and wherein the allowance radius of the allowance element is smaller than the radius of the inner curved surface of the negative mold;

and comprising the steps of:

disposing the sheet-metal part in the shaping tool;

following the disposing, moving the first shaping component and the second shaping component from an open position into a shaping position and via the moving, pressing the sheet-metal part into the negative mold by the allowance element such that the sheet-metal part is spaced apart from the second shaping component in a subregion adjoining the pressing region.

* * * * *